US007849773B1

(12) United States Patent
Hamby

(10) Patent No.: US 7,849,773 B1
(45) Date of Patent: Dec. 14, 2010

(54) RADIAL ARM FRAMEWORK WITH INTEGRAL ROOF PITCH (ANGLE) SAW GUIDE

(76) Inventor: Aubrey Eugene Hamby, 5206 Westgate, Amarillo, TX (US) 79106

( * ) Notice: Subject to any disclaimer, the term of this patent is extended or adjusted under 35 U.S.C. 154(b) by 0 days.

(21) Appl. No.: 12/215,066

(22) Filed: Jun. 25, 2008

(51) Int. Cl.
*B27B 5/20* (2006.01)

(52) U.S. Cl. ..... 83/468.3; 83/471.3; 83/928; 108/142

(58) Field of Classification Search ..... 83/455, 83/468.3, 468.4, 471.3, 477.2, 522.18, 435.26, 83/795, 928; 30/379; 108/137–143; 248/125.7, 248/432
See application file for complete search history.

(56) References Cited

U.S. PATENT DOCUMENTS 1,189,529 A * 7/1916 Benson ..... 108/29
1,593,079 A * 7/1926 Jaeger ..... 83/477.2
1,618,341 A * 2/1927 Howland ..... 83/486.1
2,633,162 A * 3/1953 Neuenschwander ..... 83/522.25
2,784,750 A * 3/1957 Thomas ..... 83/471.3
2,903,026 A * 9/1959 Frydenlund ..... 83/468.3
3,628,578 A * 12/1971 Berg ..... 83/471.3
3,730,042 A * 5/1973 Price ..... 83/471.3
3,872,755 A * 3/1975 Marsh et al. ..... 83/471.3
4,055,206 A * 10/1977 Griffin ..... 144/285
4,452,117 A * 6/1984 Brickner et al. ..... 83/471.3
4,949,945 A * 8/1990 Whiteley ..... 269/71
5,165,317 A * 11/1992 Findlay ..... 83/471.3
6,224,127 B1 * 5/2001 Hodge ..... 296/26.08
7,249,548 B2 * 7/2007 Blanco et al. ..... 83/455

* cited by examiner

*Primary Examiner*—Boyer D. Ashley
*Assistant Examiner*—Edward Landrum

(57) ABSTRACT

The invention RADIAL ARM FRAMEWORK WITH INTEGRAL ROOF PITCH ANGLE SAW GUIDE is designed to accurately control the cutting of roof pitch angles 0/12-12/12 to the right or left pitch angle in ribbed metal panels 3' wide or more for hips and valleys in buildings. Roof pitch angles can easily be changed according to an integrated guide plate.

2 Claims, 5 Drawing Sheets

RADIAL ARM FRAMEWORK WITH INTEGRAL ROOF PITCH (ANGLE) SAW GUIDE

CROSS-REFERENCE TO RELEATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a device for cutting metal panels at various angles and, more particularly, is directed towards cutting ribbed metal panels for a range of roof pitch angles and for creating useful "hips" and "valleys" therein.

2. Description of Related Art Including Information Disclosed Under 37 CFR 1.97 and 1.98

For years builders have installed galvanized ribbed sheet metal on buildings and homes to improve durability and to solve problems such as leaking roofs. Several inventors have attempted to make the cutting of metal panels for roofing more streamlined in order to simplify the "hard to do cutting" portion of their job easier. For example, cutting angles across a 3' sheet of ribbed metal for the hips and valleys with hand tools is difficult to accomplish and is not the best way to do the job. Consequently, advanced panel cutting devices which anticipate angular cutting as their primary function are not a new development. Examples of such devices are shown in U.S. Pat. Nos. 2,633,162, 7,249,548, 3,872,755, 2,784,750, and 1,618,341. Such devices have been introduced with varying degrees of success. There has arisen a need for a metal panel cutting device which accomplishes more complex cuts more simply than these prior inventions.

It is an object of the present invention to provide an adjustable angular cutting interface for easily cutting panels. Further, this invention has the added features of being easily transported to worksites by being mounted to a utility trailer and its radial dial is expressed in terms of roof pitch. Further still, this invention is designed such that panels may be are easily inserted into and removed from it by a single operator.

The invention has been developed in order to reduce the time and materials wasted by its operator. Materials are saved due to the increased accuracy when cutting panels. Likewise, time is saved when its user is able to accurately cut panels (e.g., metal roofing or plywood decking) on the ground instead of high in the air on top of the roof as has previously been the method by builders.

This invention is designed to cut roof pitch angles from zero degrees through a roof pitch of 10/12. It can cut angles either to the left or right. It can be adjusted from one cut to the next. These features are designed to anticipate the roofing workman with a limited capacity for solving the often complex mathematical problems when cutting roofing material. For example, a worker may encounter a 3 ft by 15 ft. sheet of ribbed metal consisting of multiple hips and valleys and other unusual construction features. Most such workers only have a tape measure and an assortment of hand tools (such as snips and nibblers) as they begin the task of laying the metal panel on the ground or roof to mark both edges of the sheet. Next they will have to lay a 5 or 6 ft piece of scrap 1"×4" down and mark it as well. The angle of the proposed cut will thereby be determined and the workman may proceed to cut it to the best of his ability with a small hand power saw. Occasionally a workman may have a device such as has been show in the prior art. However, even these fortunate workmen will have a limited tool to accomplish their task. For example, Blanco's invention (U.S. Pat. No. 7,249,548) operates similar to a paper cutter in that it does not provide a means for adjusting the cutting blade to various roof angles within the device.

Other objects of the present invention will in part be obvious and will in part appear hereinafter.

The invention accordingly comprises the apparatuses and systems, together with their parts, elements and interrelationships that are exemplified in the following disclosure, the scope of which will be indicated in the appended claims.

BRIEF SUMMARY OF THE INVENTION

The invention claimed is an assembly comprising an integrated means for setting the angle for guiding the interface between a chop saw and panels inserted into the assembly for cutting said panels, said angles set by said integrated means for setting said angles being defined by integral roof pitches both left and right. Part of the assembly is a track upon which a trolley carrying a chop saw will travel.

The assembly can be attached to a vehicle (e.g., a utility trailer behind a truck) and rotate out of that vehicle for easy use by it operator. In order to anchor the furthest end of the assembly a leg will hold up the assembly.

The roof pitches have settings of 1 (one) through 12 (twelve) both to the left and right of a 0 (zero) position. Also, a setting of 45 degrees may be obtained to the left and right of 12 in case that roof pitch is needed.

BRIEF DESCRIPTION OF THE SEVERAL VIEWS OF THE DRAWING(S)

A fuller understanding of the nature and objects of the present invention will become apparent upon consideration of the following detailed description taken in connection with the accompanying drawings, wherein.

DETAILED DESCRIPTION OF THE INVENTION

Turning now to the drawings. The five major system components, FIGS. 1-5, comprise the complete assembly. The 14" chop saw motor and handle mechanisms 4 are not a part of the claims of this patent application, it is included in this description to clarify the intended use of these items with the five components named above.

Figure 1:
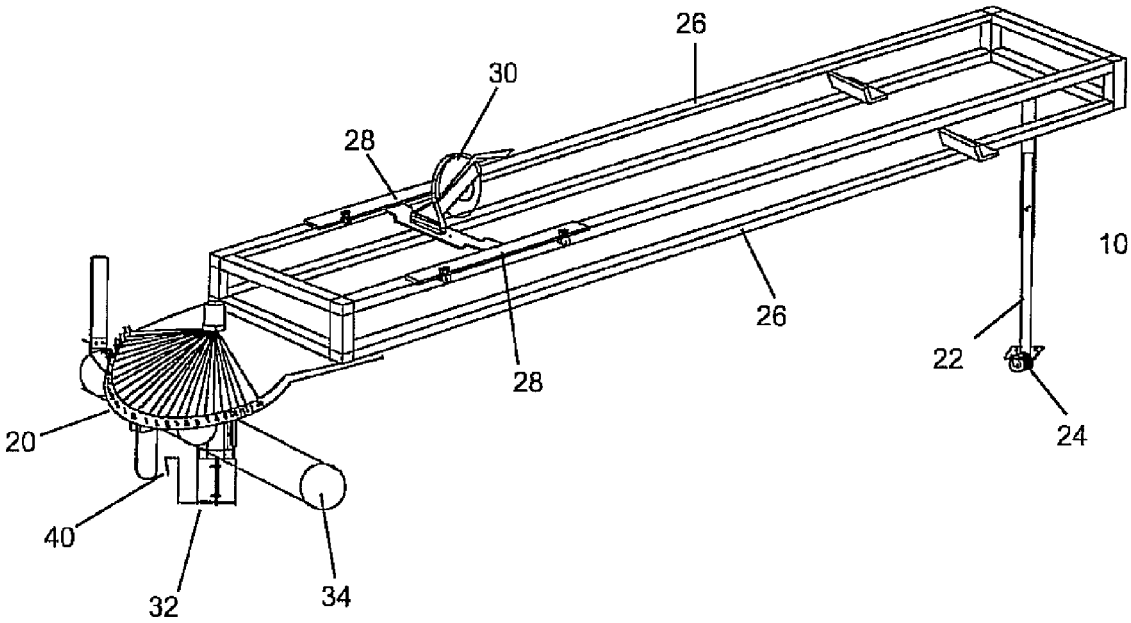
FIG. 1 illustrates a side perspective view of the preferred embodiment of the disclosed invention.
Figure 2:
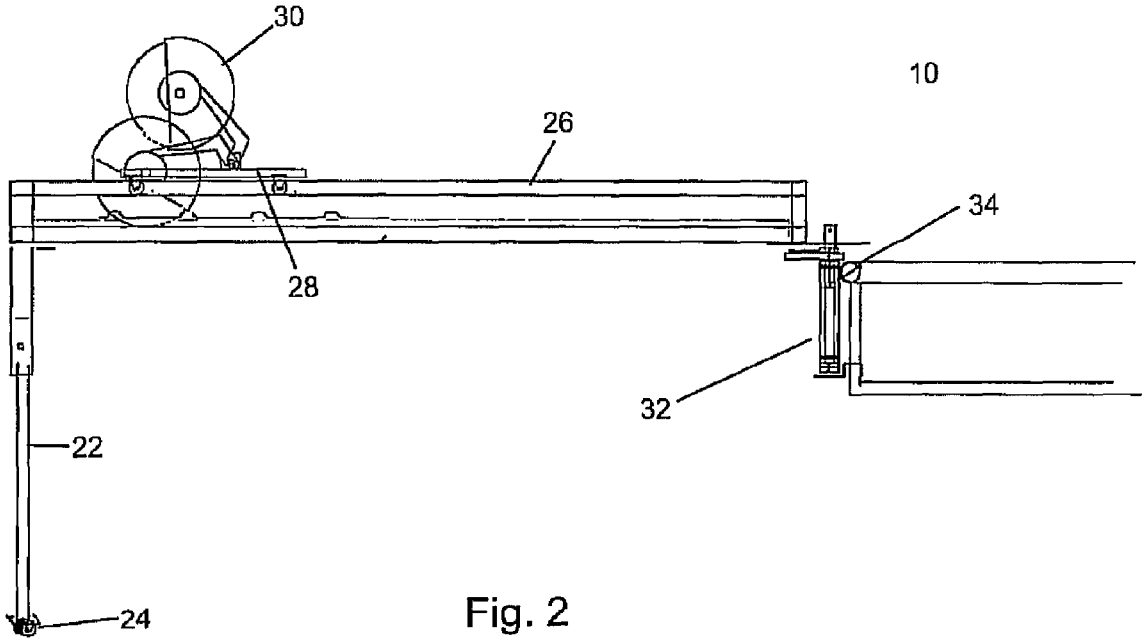
FIG. 2 illustrates a side view of the preferred embodiment of the disclosed invention.
Figure 3:
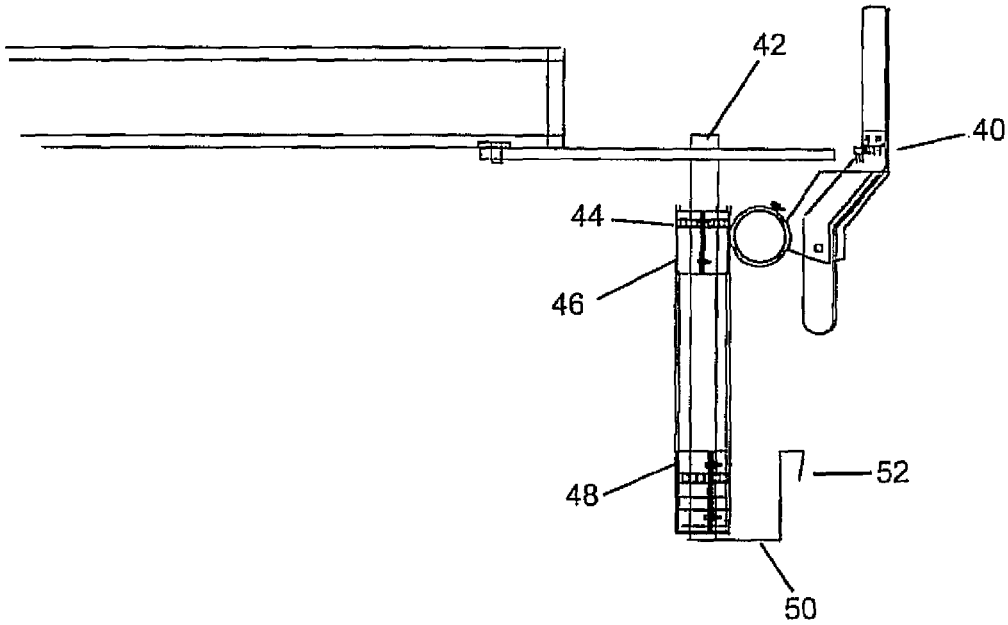
FIG. 3 illustrates a close up perspective view of a component of the disclosed invention, namely the locking control lever assembly.
Figure 4:
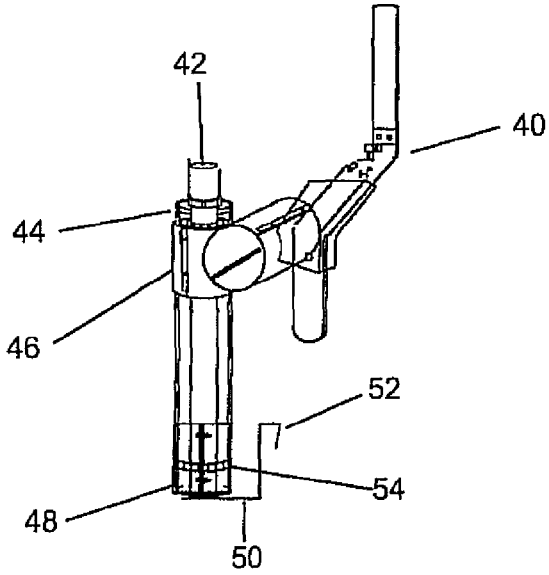
FIG. 4 illustrates a close up rotated perspective view of a component of the disclosed invention, namely the locking control lever assembly.

FIG. 1 (the entire assembly) is comprised of an integrated roof pitch angle saw guide assembly 10 having a roof pitch guide plate 20 at the proximal end and a folding adjustable leg 22 with wheel 24 at the distal end. These ends are connected by a rectangular frame 26 within which the panels will be placed for cutting. Further the frame 26 is 13"×8'×4⅘" in dimension. Upon the frame 26 is attached a trolley 28 for the 14" chop saw 30. The trolley 28 is designed to easily control the saw 30 travel even if the operator has limited experience. The integral roof pitch angle saw guide plate 20 and mounting assembly 32 are used to adjust the angle of panels inserted into the device to be cut. The mounting assembly 32 mounts the entire assembly to a vehicle such as a utility trailer's top rail 34. The mounting assembly 32 is locked to the vehicle with the use of a locking lever assembly 40. Depicted more clearly in FIG. 4, the assembly is composed of a solid steel axle 42, a ball bearing assembly 44, a double pipe hinged bracket assembly 46, a 2-¼" single hinge pipe bracket 48, a mounting bracket extension 50, a mounting bracket 52, and another ball bearing assembly 54.

Figure 5:
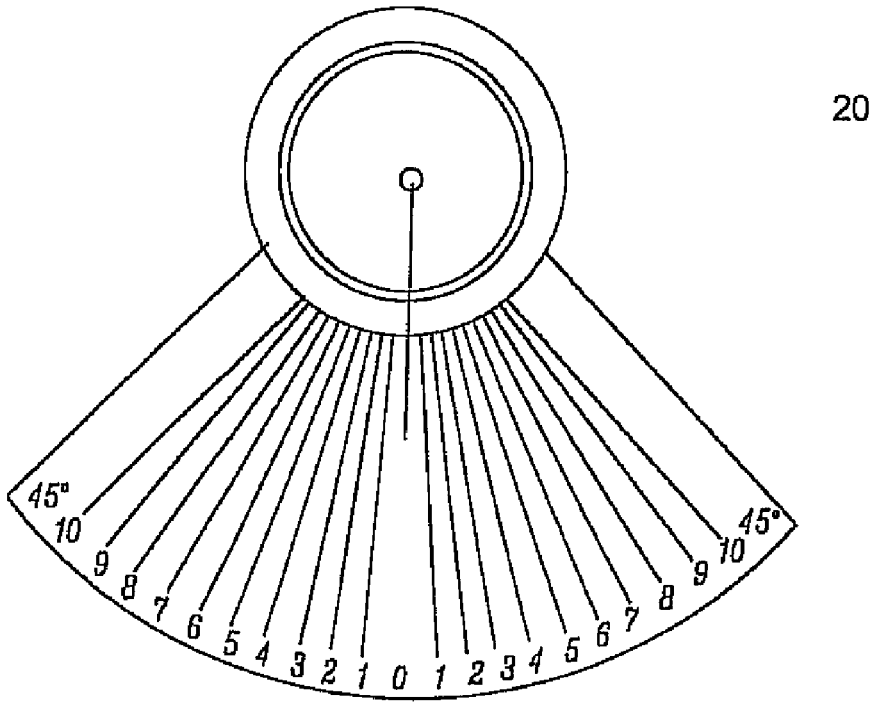
FIG. 5 illustrates a close up top view of a component of the disclosed invention, namely the chop saw in place on the trolley.
Figure 6:
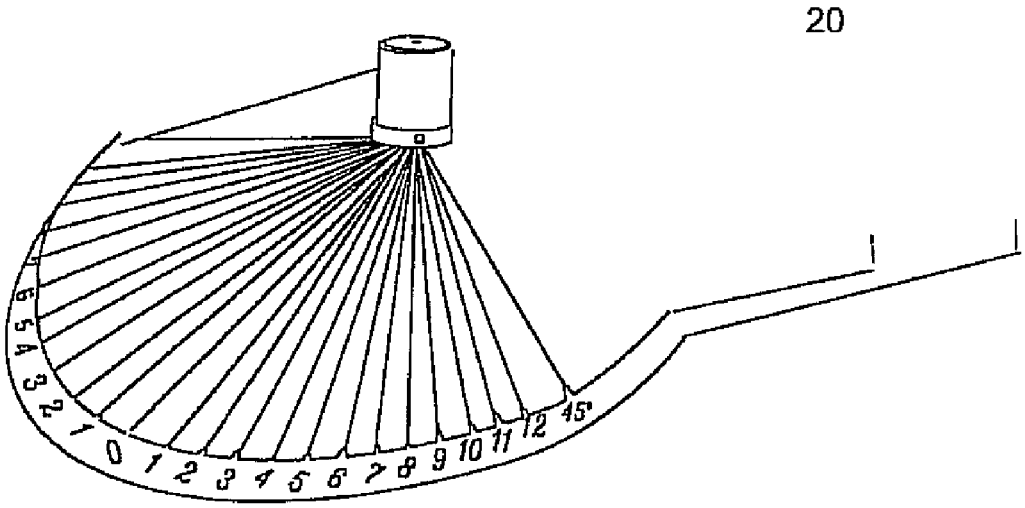
FIG. 6 illustrates a close up top view of a component of the disclosed invention, namely the saw guide plate.
Figure 7:
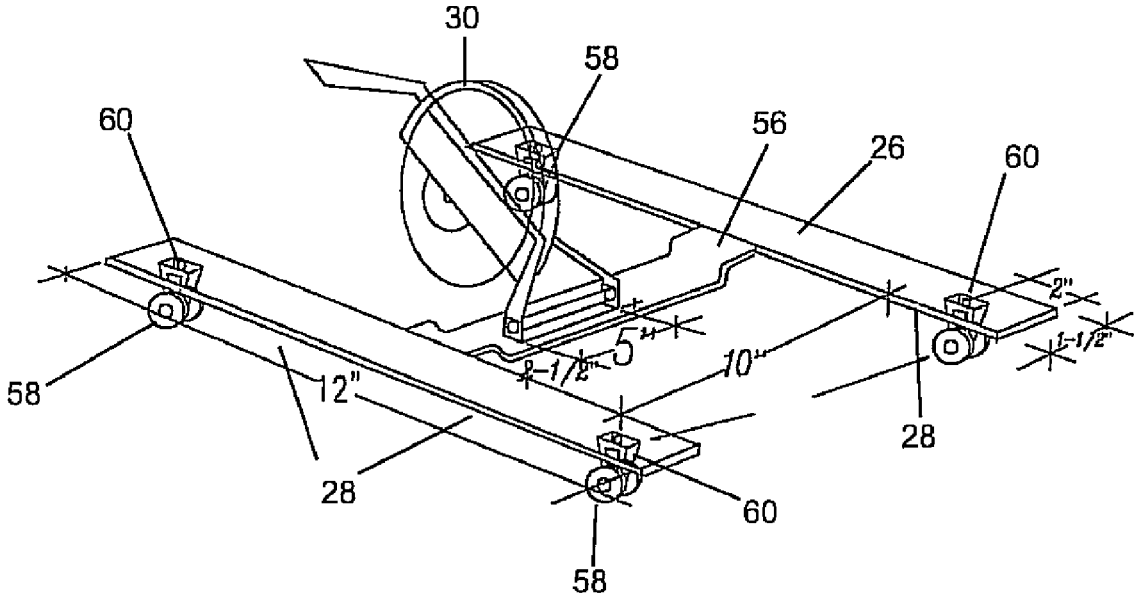
FIG. 7 illustrates a close up side view of a component of the disclosed invention, namely the saw guide plate.

As shown in more detail in FIGS. 5 and 6, the integral roof pitch angle saw guide 20 is marked with the numbers 1-12 and 45 degrees to the left and right of 0 degrees. These markings correspond to the roof pitch which will be cut into the panels fed into the assembly 10.

The trolley 28 for 14" chop saw 30 has a mounting bar 56 for the chop saw. This mounting bar 56 is attached at a right angle at both ends to 12"×1½" pieces which each have two P2749 trolley wheels 58 with shroud 60 attached to them. This trolley 28 is designed to allow the chop saw 30 to move back and forward on the panels put into the assembly 10.

The disclosed method and apparatus is designed to work more efficiently and economically than most if not all other current methods. Angles include, but are not limited to: "0", 1/12, 2/12, 3/12, 4/12, 5/12, 6/12, 7/12, 8/12, 9/12, 10/12, & 45 degree both right angle and also the same pitch left angle. The disclosed method and apparatus helps to eliminate, the sometimes, costly material waste and labor costs by reducing time spent doing the math required to measure and accurately cut each sheet. The disclosed method and apparatus replaces the hand tools almost entirely by providing accurate cuts smoothly, quickly and economically on the many metal roofs appearing more and more frequently in the public construction work place. The disclosed method and apparatus replaces most, if not all, of the antiquated makeshift methods devised by many metal workers on the jobsite, providing greater and more complete choice of pitch cuts automatically without time consuming equipment modification. The uneven surface present in the ribbed metal will prevent most hand tools that are designed to cut across a smooth surface.

The invention claimed is:

1. A portable assembly for cutting hips and valleys into ribbed metal panels, the assembly comprising:

a rectangular frame for holding ribbed metal panels during cutting, said rectangular frame having a proximal end and a distal end, the proximal end having a mounting assembly for mounting the frame to the top rail of a vehicle utility trailer said mounting assembly having a rotating means for allowing the frame to rotate, a foldable leg having a first end mounted to the distal end of the rectangular frame and a second end for engaging with the ground such that the frame is supported at a height level with the proximal end when the frame is rotated out from the trailer, a track mounted above the rectangular frame and a trolley guided in the track, said trolley having a plurality of wheels and a mounting bar on which a chop saw for cutting said panels is mounted, a saw guide plate marked with sequential numbers, both to the left and right of a zero position, said numbers representing roof pitches and corresponding to angles from zero to forty-five degrees, said saw guide plate mounted on the proximal end of said rectangular frame, a locking lever fixedly mounted to the mounting assembly and capable of releasably engaging with the saw guide plate at a desired position corresponding with a marked number on said plate, said locking lever when in a released position allowing rotation of the frame and when in an engaged position effectuating locking of the frame into an immobilized state.

2. The assembly of claim 1 wherein the foldable leg has a wheel mounted to the second end.

* * * * *